US009305473B1

(12) United States Patent
Alunni

(10) Patent No.: US 9,305,473 B1
(45) Date of Patent: Apr. 5, 2016

(54) SIGN ASSEMBLY

(71) Applicant: Claude Alunni, Cobourg (CA)

(72) Inventor: Claude Alunni, Cobourg (CA)

( * ) Notice: Subject to any disclaimer, the term of this patent is extended or adjusted under 35 U.S.C. 154(b) by 0 days.

(21) Appl. No.: 14/592,957

(22) Filed: Jan. 9, 2015

(51) Int. Cl.
*G09F 15/00* (2006.01)
*A47G 1/06* (2006.01)
*G09F 21/04* (2006.01)

(52) U.S. Cl.
CPC ..... *G09F 15/00* (2013.01); *A47G 1/065* (2013.01); *G09F 21/04* (2013.01); *G09F 21/048* (2013.01)

(58) Field of Classification Search
CPC ..... G09F 21/04; G09F 21/048; G09F 11/26; G09F 2007/1865; G09F 7/02
USPC ..... 40/524, 472, 611.09, 611.1
See application file for complete search history.

(56) References Cited

U.S. PATENT DOCUMENTS 302,723 A * 7/1884 Grimes ..... G09F 11/26 40/525
3,255,725 A * 6/1966 Von Kreidner ..... B60Q 7/02 116/173
3,395,472 A * 8/1968 Look ..... G09F 11/26 40/472
3,430,374 A * 3/1969 Woodard ..... B60Q 7/005 40/514
3,590,506 A * 7/1971 Jeski ..... B60Q 7/005 116/28 R
3,594,938 A * 7/1971 Mosch ..... G09F 21/04 40/591
4,779,368 A 10/1988 Thede
4,937,962 A * 7/1990 Hornblad ..... G09F 7/00 40/604
6,216,374 B1 * 4/2001 Lawrence ..... G09F 3/20 40/604
6,785,990 B2 9/2004 Tomlin et al.
7,117,619 B1 * 10/2006 Huber ..... A63B 71/0672 116/222
7,444,773 B2 11/2008 Kolodziejezak, Sr.
8,327,567 B2 12/2012 Swick et al.
2002/0017044 A1 * 2/2002 Tomlin ..... G09F 15/0025 40/463
2004/0025388 A1 * 2/2004 Coates ..... G09F 11/15 40/524
2004/0128888 A1 * 7/2004 Payan ..... G09F 15/0062 40/610
2004/0244244 A1 * 12/2004 Klassen ..... G09F 11/28 40/472
2005/0081413 A1 4/2005 Ko
2005/0252053 A1 11/2005 Pena
2010/0319228 A1 12/2010 Yablonowski

* cited by examiner

*Primary Examiner* — Gary Hoge

(57) ABSTRACT

A sign assembly for displaying information about a vehicle includes a vehicle that has a hood and a front side. A display is coupled to the vehicle. The display is visible forward of the front side. The display may contain information and images pertaining to the vehicle. The display extends between the hood and the front side. A belt is movably coupled to the display. A plurality of pockets is coupled to said belt and contains the information about the vehicle.

7 Claims, 4 Drawing Sheets

SIGN ASSEMBLY

BACKGROUND OF THE DISCLOSURE

Field of the Disclosure

The disclosure relates to sign devices and more particularly pertains to a new sign device for displaying information about a vehicle.

SUMMARY OF THE DISCLOSURE

An embodiment of the disclosure meets the needs presented above by generally comprising a vehicle that has a hood and a front side. A display is coupled to the vehicle. The display is visible forward of the front side and contains information pertaining to the vehicle. The display extends between the hood and the front side. A belt is movably coupled to the display. A plurality of pockets is coupled to said belt and contains the information about the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
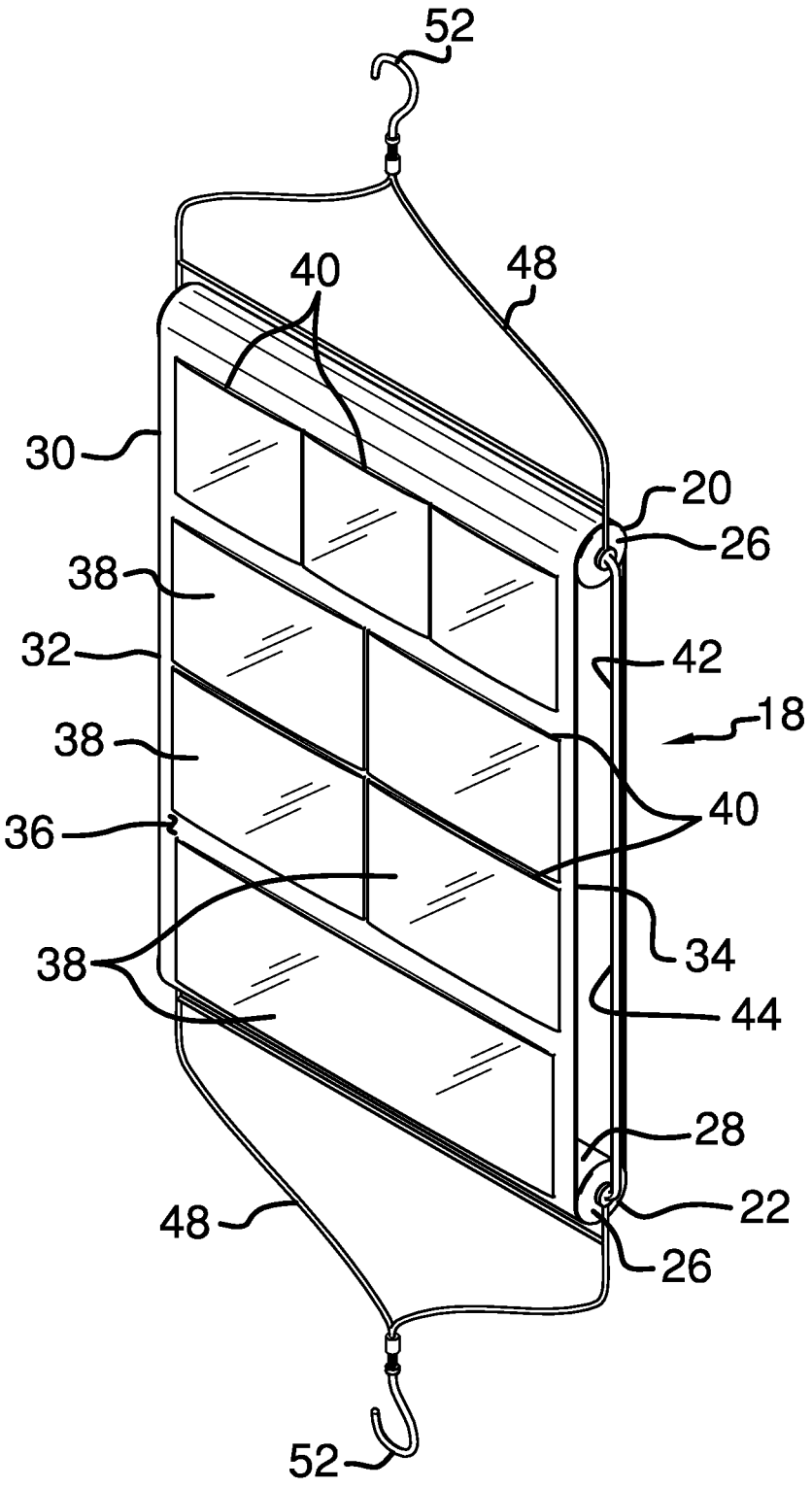
FIG. 1 is a perspective view of a sign assembly according to an embodiment of the disclosure.
Figure 2:
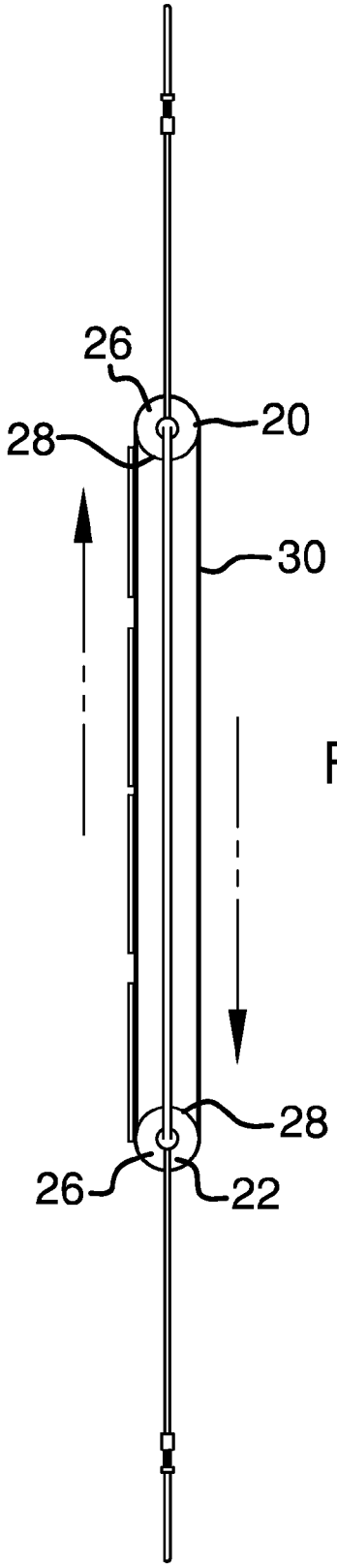
FIG. 2 is a right view of an embodiment of the disclosure.
Figure 3:
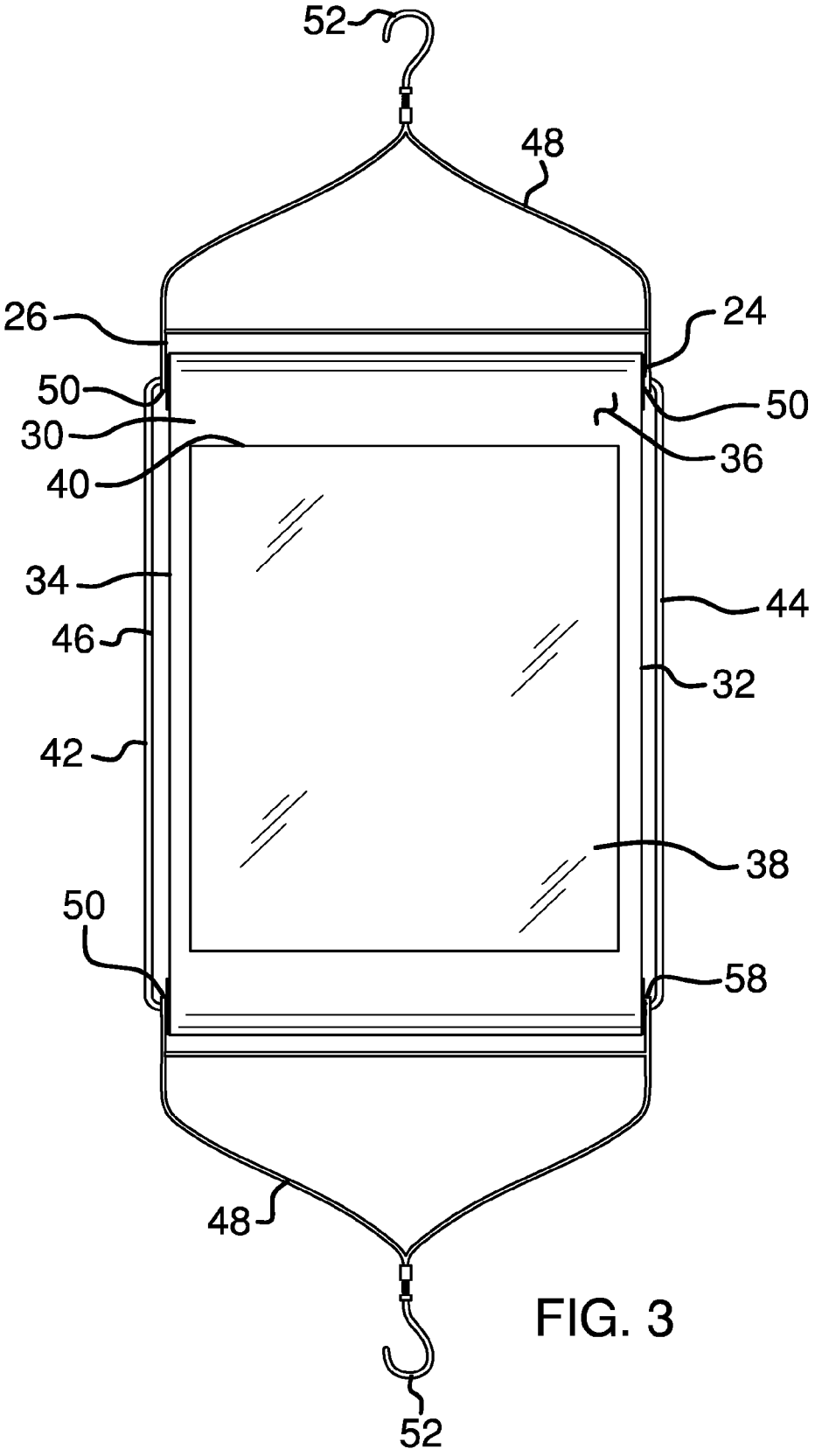
FIG. 3 is a back view of an embodiment of the disclosure.
Figure 4:
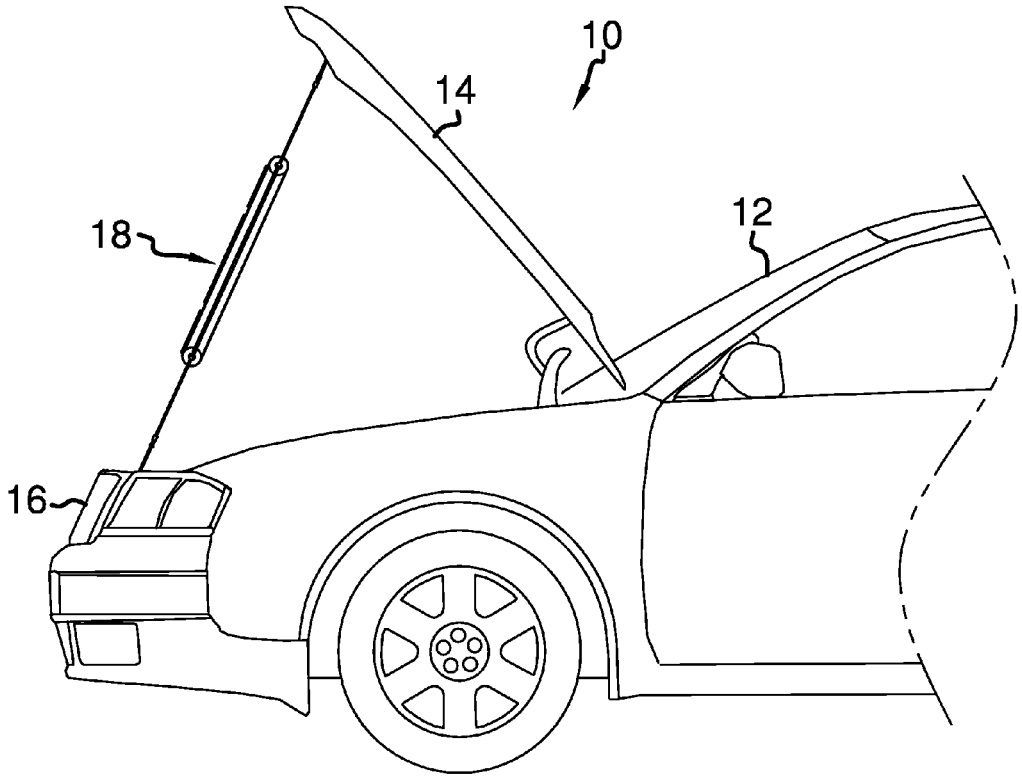
FIG. 4 is an in-use view of an embodiment of the disclosure.

With reference now to the drawings, and in particular to FIGS. 1 through 4 thereof, a new sign device embodying the principles and concepts of an embodiment of the disclosure and generally designated by the reference numeral 10 will be described.

As best illustrated in FIGS. 1 through 4, the sign assembly 10 generally comprises a vehicle 12 that has a hood 14 and a front side 16. The vehicle 12 may be a classic car or the like that may have undergone substantial restoration. A display 18 is coupled to the vehicle 12. The display 18 is visible forward of the front side 16.

The display 18 comprises a first roller 20 and a second roller 22. Each of the rollers 20, 22 has a first end 24, a second end 26 and a peripheral wall 28 extending therebetween. Each of the rollers 20, 22 has a cylindrical shape and each is elongated between the first 24 and second 26 ends.

A belt 30 is provided that has a first lateral edge 32, a second lateral edge 34 and an outer surface 36 extending therebetween. The belt 30 is continuous and forms a closed loop. The belt 30 extends around the first roller 20 and the second roller 22 such that the outer surface 36 is visible to an observer. Moreover, the belt 30 extends between the first end 24 and the second end 26 of the rollers 20, 22.

A plurality of pockets 38 is coupled to the outer surface 36 and is distributed along the outer surface 36. The pockets 38 may contain information and images pertaining to the vehicle 12. Each of the pockets 38 has an open top side 40.

A frame 42 is provided. The frame 42 includes a first arm 44 and a second arm 46. The first arm 44 extends between the first ends 24 of the first roller 20 and the second roller 22. The second arm 46 extends between the second ends 26 of the first roller 20 and the second roller 22. The frame 42 spaces the first roller 20 from the second roller 22. Additionally, the frame 42 orients the first roller 20 on a rotational axis that is parallel to a rotational axis of the second roller 22. The first 44 and second 46 arms may be coupled together within each of the rollers 20, 22.

A pair of couplers 48 is provided. Each of the couplers 48 has a pair of ends 50. A hook 52 is coupled to each of the couplers 48. The hook 52 is centrally positioned on the coupler 48. Each of the ends 50 of the couplers 48 are attached the frame 42 adjacent the first 24 and second 26 ends of the rollers 20, 22. One of the couplers 48 is positioned on the first roller 20 and is removably attached to the hood 14. One of the couplers 48 is positioned on the second roller 22 and is removably attached to the front side 16. The hooks 52 each engage the associated hood 14 and front side 16.

In use, the information and images pertaining to the vehicle 12 are positioned in selected pockets 38. The belt 30 is rolled on the rollers 20, 22 to display selected ones of the pockets 38 to the observer. The display 18 may be used at car shows or other events involving showing the vehicle 12 to observers.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sign assembly configured to display information about a vehicle, said assembly comprising:

a vehicle having a hood and a front side;

a display coupled to the vehicle, said display being visible forward of said front side, said display being configured to contain information pertaining to said vehicle, said display extending between said hood and said front side;

a belt movably coupled to said display; and a plurality of pockets coupled to said belt, said pockets being configured to contain the information about said vehicle.

2. The assembly according to claim 1, wherein said display comprising a first roller and a second roller each having a first end, a second end and a peripheral wall extending therebetween, each of said rollers having a cylindrical shape.

3. The assembly according to claim 2, wherein said belt has a first lateral edge, a second lateral edge and an outer surface extending therebetween, said belt being continuous and forming a closed loop, said belt extending around said first roller and said second roller, said outer surface being configured to be visible to an observer, said belt extending between said first end and said second end of said rollers.

4. The assembly according to claim 3, wherein said plurality of pockets is coupled to said outer surface, said pockets being distributed along said outer surface, said pockets being configured to contain information and images pertaining to said vehicle, each of said pockets having an open top side.

5. The assembly according to claim 2, wherein a frame extends between said first ends of said first roller and said second roller and said second ends of said first roller and said second roller such that said first roller is spaced from said second roller.

6. The assembly according to claim 5, further including a pair of couplers attached to said frame, one of said couplers being coupled to said first roller and being removably attached to said hood, one of said couplers being coupled to said second roller and being removably attached to said front side, each of said couplers including a hook.

7. A sign assembly configured to display information about a vehicle, said assembly comprising:

a vehicle having a hood and a front side;

a display coupled to the vehicle, said display being visible forward of said front side, said display comprising:

a first roller and a second roller each having a first end, a second end and a peripheral wall extending therebetween, each of said rollers having a cylindrical shape;

a belt having a first lateral edge, a second lateral edge and an outer surface extending therebetween, said belt being continuous and forming a closed loop, said belt extending around said first roller and said second roller, said outer surface being configured to be visible to an observer, said belt extending between said first end and said second end of said rollers;

a plurality of pockets coupled to said outer surface, said pockets being distributed along said outer surface, said pockets being configured to contain information and images pertaining to said vehicle, each of said pockets having an open top side;

a frame extending between said first ends of said first roller and said second roller and said second ends of said first roller and said second roller such that said first roller is spaced from said second roller; and a pair of couplers attached to said frame, one of said couplers being coupled to said first roller and being removably attached to said hood, one of said couplers being coupled to said second roller and being removably attached to said front side, each of said couplers including a hook.

* * * * *